United States Patent [19]

Siwersson

[11] 4,167,882

[45] Sep. 18, 1979

[54] ADJUSTABLE WRENCH

[76] Inventor: Olle L. Siwersson, Gartnergatan 4, 252 51 Helsingborg, Sweden

[21] Appl. No.: 852,655

[22] Filed: Nov. 18, 1977

Related U.S. Application Data

[63] Continuation of Ser. No. 667,583, Mar. 17, 1976, abandoned.

[51] Int. Cl.[2] ..... B25B 13/00; B25B 13/16

[52] U.S. Cl. ..... 81/186; 81/176

[58] Field of Search ..... 81/119, 176, 186

[56] References Cited

U.S. PATENT DOCUMENTS

| | | | |
|---|---|---|---|
| 2,704,004 | 3/1955 | Johnson | 81/186 X |
| 3,785,226 | 1/1974 | Ward | 81/119 |
| 3,881,377 | 5/1975 | Evans et al. | 81/119 X |

*Primary Examiner*—James G. Smith

*Attorney, Agent, or Firm*—Karl W. Flocks

[57] ABSTRACT

Adjustable wrench with two jaws for engaging four contiguous sides of a hexagonal body. The operative jaw surfaces for engaging the two opposite parallel faces of the body engage only part of these faces. The said operative jaw surface of one of the jaws extends only a short distance upwardly along one of said opposite parallel faces near the hexagon corner embraced by this jaw. The said operative jaw surface on the other jaw is divided into two generally coplanar surface portions with an interjacent recess, the operative face portion next to the hexagon corner embraced by this jaw forming a short setting shoulder.

11 Claims, 2 Drawing Figures

FIG. 1
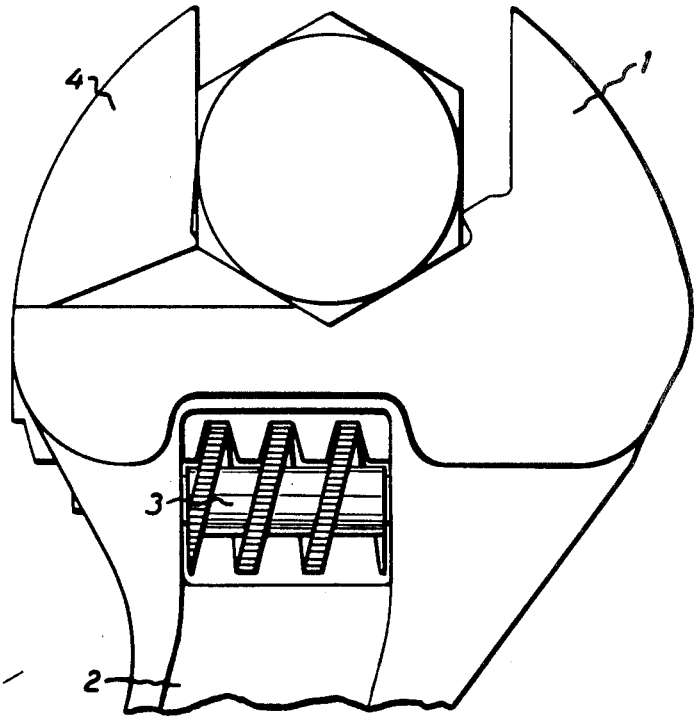
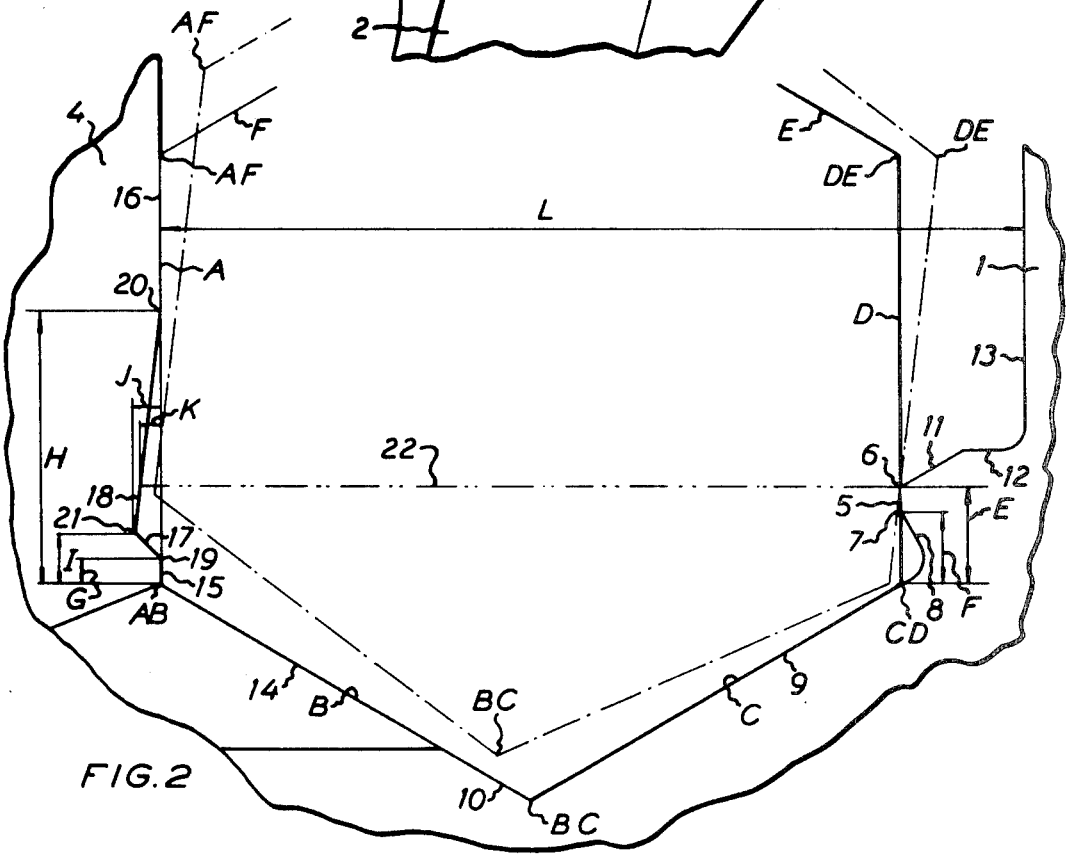
FIG. 2

ADJUSTABLE WRENCH

This is a continuation of application Ser. No. 667,583, filed Mar. 17, 1976, now abandoned.

It is known that fixed-jaw type wrenches for hexagonal nuts or bolt-heads can be formed in a manner to permit rotation of the hexagonal body when turning the wrench in one direction of rotation while, when turning in the opposite direction, the wrench "snaps" past the corners of the hexagonal body, which makes it unnecessary to lift the wrench off the hexagonal body between each turning movement. These previously known fixed-jaw wrenches function exellently but have the disadvantage that different wrenches are required for different dimensions of the hexagonal nut or bolt-head.

From the Swedish Patent Specification No. 330,516 there is known such a "snap wrench" in the form of an adjustable wrench. This wrench has, however, the disadvantage that, if it is to perform a faultless snapping action, it must not be tightened so as to bear too heavily against the nut or bolt-head. The necessary "loose" tightening has had a result that this adjustable wrench, which per se is excellent, has not achieved the success that it deserves.

The object of the present invention is to overcome the disadvantages of conventional "snapping type" wrenches and this concerns an adjustable wrench arranged to engage four contiguous sides of a body shaped as a generally regular hexagon, said wrench having two jaws each engaging two of the sides of the hexagon, said jaws including operative portions adapted to engage only parts of two opposite parallel sides of the hexagon.

The disadvantages of the prior art "snapping type" wrenches are eliminated by the present invention, wherein one jaw includes an operative portion extending only a short distance upwardly along one of said two parallel sides of the hexagon, and the other jaw includes two generally coplanar operative face portions adapted to engage the other of said two parallel sides of the hexagon, a recess preventing engagement being provided between the two last-mentioned operative face portions, the operative portion adjacent the hexagon corner embraced by said jaw being in the form of a setting shoulder which is sufficiently large to permit engagement against one of said two parallel sides of the hexagon as a preparation for turning the wrench in one direction but yet sufficiently small to permit slipping past said embraced corner when turning the wrench in the opposite direction.

The invention will now be described in more detail with reference to the accompanying drawings in which:

FIG. 1 shows an adjustable wrench according to the present invention, in which the wrench handle substantially has been left out; and FIG. 2 shows on a larger scale a portion of the jaw area of the wrench of FIG. 1.

The adjustable wrench according to the present invention includes, like conventional wrenches, a fixed jaw which is rigidly connected with a handle 2. Rotatably mounted within the handle is an adjustment screw 3. This screw meshes with a correspondingly threaded adjustable jaw 4. In FIG. 1 the wrench is shown in a position of maximum opening width.

For the further description of the wrench, reference is made to FIG. 2, from which it is apparent that the wrench engages the contiguous sides A, B, C, and D of a hexagonal bolt-head. The drawings show this bolt-head with sharp corners but in reality they are slightly rounded. The movable jaw 4 engages the sides A and B while the fixed jaw 1 engages the sides C and D. The fixed jaw interferes only with a portion of the side D and, in the embodiment shown, the jaw 1 has an operative portion 5 extending between two limits 6 and 7. The distance E between the limit 6 and the corner CD, as measured in parallel with the side D, is about 13% of the maximum opening width of the wrench. The distance F between the limit 7 and the corner CD is about 9.5% of said maximum opening width. Between the limit 7 and the corner CD there is a recess 8 preventing deformation of the corner CD in that the engagement of the jaw 1 with the side D will thereby necessarily take place at a distance from the corner CD.

The fixed jaw 1 includes a face portion 9 engaging the entire side C of the hexagon. At maximum opening of the wrench, the fixed jaw also displays a face portion 10 engaging a short length of the hexagon side B. However, the recess in the fixed jaw, which is defined by this face portion 10, is not necessary but serves only to reduce the size of the wrench, as measured along the handle.

Outside the limit 6 the fixed jaw 1 extends obliquely outwardly by a face portion 11 which is generally parallel with the face 9. After this portion 11 comes a recess-forming face portion 12 joining the face portion 11 with a face portion 13 which is parallel with the side D of the hexagon.

The movable jaw of the wrench has a face portion 14 which engages the side B of the hexagon and, at maximum opening of the wrench, lies in the same plane as the face portion 10 of the fixed jaw. The movable jaw portion engaging the side A of the hexagon includes two operative face portions 15 and 16 which are interconnected by two recess-forming face portions 17, 18.

The operative portion 15 extends from the corner AB to an upper limit 19 and thus forms a small shoulder adjacent the corner AB. The limit 19 is spaced from the corner AB by a distance G amounting to about 3% of the maximum opening width of the wrench. The operative portion 16 begins at a limit 20 which, in the embodiment shown, is spaced from the corner AB by a distance H amounting to about 35% of the maximum opening width of the wrench. From the limit 20 the operative portion 16 extends up to the outer end of the jaw 4. The operative portions 15 and 16 thus lie in the same plane and this is parallel with the plane of the operative portion 5 of the fixed jaw 1 and it is also parallel with the plane of face 13 of the fixed jaw 1.

In the embodiment shown the recess-forming faces 17, 18 are carried out as flat surfaces but may as well be formed as curved surfaces or as a curved surface of suitable configuration. The recess defined by the faces 17, 18 has its deepest point 21 spaced from the corner AB by a distance I amounting to about 6.5% of the maximum opening width of the wrench. The depth J of the recess, as measured at right angles to the plane common to the operative portions 15, 16 is about 3.3% of the maximum opening width of the wrench. On a level (line 22) with the outer limit 6 of the operative portion 5 of the fixed jaw 1 the recess defined by the face portions 17, 18 has a depth K amounting to about 2.7% of the maximum opening width, as measured at right angles to the plane common to the operative faces 15 and 16.

The distance L between the plane of the operative faces 15, 16 and the plane of the face 13 is, in the embodiment shown, about 117% of the maximum opening width. This distance L must at any event be greater than the distance between two opposite corners of the hexagon, e.g. the corners AB and DE.

In the drawing, the wrench is shown in position for tightening a right-handed threaded bolt or nut. Clockwise turning of the wrench thus involves tightening of the bolt or nut.

When the wrench is to be adjusted to fit the nut or bolt-head, the face portions 9 and 14 and, when appropriate, also the face portion 10 of the wrench are brought into engagement with the sides B and C of the hexagon. After that the movable jaw 4 is screwed inwardly against the hexagon so that this is clamped between the operative face 5 and the two operative faces 15 and 16. This is followed by a tightening movement caused by clockwise turning of the wrench. This turning movement is then reversed into anti-clockwise direction, whereby the hexagonal bolt or nut remains in its position and the wrench starts pivoting about the limit line 6 on the operative face 5. At this pivoting movement the corner AB moves upwardly into the recess defined by the face portions 17, 18, and because of the slightly bevelled configuration of the corner this will escape the shoulder formed of the operative face portion 15 and swing upwardly to the position represented by dot-and-dash lines, whereupon the operative face portion of shoulder 5 will slip along the bolt surface D until this shoulder 5 snaps past the corner DE and, when called for, wents on past the corners EF, AF, etc, and by reversing again the turning direction into clockwise rotation, a new engagement is established with four contiguous face portions of the hexagonal nut or bolt, after which it will be possible to achieve another tightening operation.

When a bolt or a nut is to be loosened, the wrench is turned over in the usual way so that the movable jaw and the fixed jaw will change positions.

If desiring to utilize the wrench as an ordinary wrench without snapping action, one may screw together the jaws so much that the hexagonal bolt-head will not interfere with the faces 9 and 14 but only engage the faces 13, 11 and 16.

The percentual figures indicated above for the extent of the various surfaces are the preferred ones and they are based on a compromise between, on one hand, the greatest possible leverage for the engagement between the operative face 5 with the side D, and, on the other hand, the desire to prevent deformation of the corner CD. The lever becomes greater and the risk of damaging the corner CD becomes greater according as the point of engagement of the face 5 with the surface D is closer to the corner CD. If, on the other hand, the face portion 5 is placed too far from the corner CD the lever will become too short.

The recess 8 between the face portion 5 and the face 9 is not necessary in and per se, but this recess is preferred to make sure that the pressure against the face D is applied at a distance from the corner CD so that this will not be damaged.

The face portions and dimensions that are most important to the function of the wrench are those represented by the distances E, F, G, H, K and L. As long as the recess defined by the faces 17 and 18 are shaped so as to prevent engagement, so that the pivoting movement of the corner AB about the limit line 6 of the operative face 5 is not made impossible by engagement with the face of the recess of the movable jaw between its operative faces 15 and 16, then the distances I and J has no decisive effect upon the "snapping" action of the wrench. Thus, the configuration of the recess in question can, as pointed out above, be varied even if, from a manufacturing point of view, it is preferred to use the configuration shown in the drawing where the recess is defined by two substantially straight lines and where the greatest depth of the recess has been placed between the upper edge 19 of the operative face 15 and the level (line 22) for the upper edge 6 of the operative face 5 of the fixed jaw. When the deepest point 21 of the recess is so placed, the distance I should preferably be 6–8% and the distance $J \geqq 3\%$.

As pointed out above, the measurement statements indicated above for the various face portions and the distances E, F, G, H, K and L are preferred. While substantially maintaining the requirement for the snapping function of the wrench, the distances may be varied within the following ranges, based on the maximum opening width of the wrench:

Distance E=9.5–13.5%
Distance F=0–9.5%
Distance G=2.5–4%
Distance H=30–35%
Distance $K \geqq 2.6\%$
Distance $L \geqq 115\%$

What I claim and desire to secure by Letters Patent is:

1. An adjustable wrench designed to engage four contiguous sides of a body shaped as a generally regular hexagon, comprising two jaws on said wrench each for engaging two sides of the hexagon body, each of said two jaws inluding two juxtaposed partly discontinuous surfaces lying on the periphery of an open hexagon, the partly discontinuous surface of one of said jaws being adapted to engage only a part of one of two opposite parallel sides of the hexagon body, said partly discontinuous surface of said one jaw extending only a short distance upwardly along one of said two parallel sides of the hexagon body near the hexagon corner embraced by said one jaw, said partly discontinuous surface of said other jaw including two substantially fully coplanar portions adapted to engage two parts of the other of two parallel sides of the hexagon body and having an interjacent recess-forming engagement-preventing area, one of said two portions being adjacent the hexagon corner embraced by said other jaw and forming a setting shoulder which is sufficiently large to permit engagement against one of said two parallel sides of the hexagon body when said hexagon body is fully seated between said jaws as a preparation for turning the wrench in one direction but yet sufficiently small to permit slipping past said embraced corner when turning the wrench in the opposite direction without withdrawing said wrench from said hexagon body.

2. An adjustable wrench designed to engage four contiguous sides of a body shaped as a generally regular hexagon comprising two jaws on said wrench each for engaging two sides of the hexagon body, operative surfaces on said jaws being adapted to engage only parts of two opposite parallel sides of the hexagon body, said operative surface of one jaw extending only a short distance upwardly along one of said two parallel sides of the hexagon body near the hexagon corner embraced by said one jaw, said operative surface of said other jaw including two substantially fully coplanar operative face portions with an interjacent recess-forming engagement-preventing face portion, said operative face portion adjacent the hexagon corner embraced by said other jaw forming a setting shoulder which is sufficiently large to permit engagement against one of said two parallel sides of the hexagon body when said hexagon body is fully seated between said jaws as a preparation for turning the wrench in one direction but yet sufficiently small to permit slipping past said embraced corner when turning the wrench in the opposite direction without withdrawing said wrench from said hexagon body, said operative surface of said one jaw engaging one of the two parallel sides of the hexagon having, as measured from the hexagon corner embraced by said one jaw, a farther limit spaced from said corner by a distance amounting to 9.5–13.5% of the maximum opening width of the wrench, said setting-shoulder-forming operative face portion of said other jaw extending away from the hexagon corner embraced by said other jaw a distance corresponding to 2.5–4% of the maximum opening width of the wrench, and the other of said two generally coplanar operative face portions of said other jaw starting at a distance from the last-mentioned hexagon corner, corresponding to 30–35% of the maximum opening width of the wrench.

3. An adjustable wrench as claimed in claim 1, wherein said two substantially fully coplanar portions and said interjacent recess-forming engagement-preventing area are formed in the movable jaw of the wrench.

4. An adjustable wrench as claimed in claim 2, wherein the depth of the engagement-preventing recess formed by said recess-forming face portion on said one jaw, on a level with said farther limit for said operative surface of said other jaw, amounts to $\geqq 2.6\%$, based on the maximum opening width of the wrench and measured at right angles to the plane common to said two operative face portions.

5. An adjustable wrench as claimed in claim 4, wherein the greatest depth of the engagement-preventing recess formed by said recess-forming face portion on said other jaw is at a distance of 6–8% from the hexagon corner embraced by said other jaw and has a depth of at least 3%, in both cases based on the maximum opening width of the wrench and measured respectively in parallel with and at right angles to the plane common to said two operative face portions of said other jaw, and the recess extends from said deepest point obliquely up to said operative face portions situated on either side.

6. An adjustble wrench as claimed in claim 1, wherein said one jaw has a surface portion located outside the partly discontinuous surface thereof and extending in parallel with said two substantially fully coplanar portions of said other jaw, said surface portion being spaced from said two substantially fully coplanar portions by a distance corresponding to at least 115% of the maximum opening width of the wrench, as measured at right angles to said two substantially fully coplanar portions, when the wrench is adjusted to its maximum width.

7. An adjustable wrench as claimed in claim 1, wherein said one jaw has a recess-forming surface portion between the partly discontinuous surface thereof and the hexagon corner embraced by said one jaw.

8. An adjustable wrench as claimed in claim 7, wherein said partly discontinuous surface of said one jaw has an operative portion beginning at a distance from the hexagon corner embraced by said one jaw, corresponding to about 9.5% of the maximum opening width of the wrench.

9. An adjustable wrench as claimed in claim 7, wherein said operative portion of said one jaw ends at a distance from the hexagon corner embraced by said one jaw, corresponding to about 13% of the maximum opening width of the wrench.

10. An adjustable wrench as claimed in claim 1, wherein said setting-shoulder-forming portion of said other jaw ends at a distance from the hexagon corner embraced by said other jaw, corresponding to about 3% of the maximum opening width of the wrench.

11. An adjustable wrench as claimed in claim 1, wherein said one jaw has a surface portion joining the outer limit of said partly discontinuous surface of said one jaw and being generally parallel with the other side of the hexagon which said one jaw is adapted to engage.

* * * * *